US005433549A

United States Patent [19]

McGaffigan

[11] Patent Number: 5,433,549

[45] Date of Patent: Jul. 18, 1995

[54] FLEXIBLE TIE STRUT

[75] Inventor: Thomas H. McGaffigan, 1563 Mizzen La., Half Moon Bay, Calif. 94019

[73] Assignee: Thomas H. McGaffigan, Saratoga, Calif.

[21] Appl. No.: 118,492

[22] Filed: Sep. 7, 1993

[51] Int. Cl.[6] ..... F16B 7/00; A63H 33/00

[52] U.S. Cl. ..... 403/229; 403/223; 403/220; 403/41; 403/291; 403/178; 403/174; 403/170; 403/349; 446/119; 446/126

[58] Field of Search ..... 446/126, 123, 119, 122; 52/655.2, 655.1, 646, 653.1, 81.3; 135/106, 101, 102, 105; 403/169-171, 176-178, 217, 396, 389, 348, 349, 203, 41, 202, 220, 223, 229, 291; 16/DIG. 33, 225, 226, 286, 298, 392

[56] References Cited

U.S. PATENT DOCUMENTS

Re. 7,114 5/1876 Wild .
1,113,371 10/1914 Pajeau .
1,588,900 6/1926 McGrath .
1,608,592 11/1926 Funk .
1,707,691 4/1929 Sweet .
1,843,115 2/1932 Ferris .
1,898,297 2/1933 Fox .
2,363,785 11/1944 Gold .
2,509,100 5/1950 Jordan .
2,509,115 5/1950 Wait et al. .
2,530,964 11/1950 Hirsch ..... 403/229 X
2,559,160 7/1951 Jacob .
2,633,662 4/1953 Nelson .
2,683,329 7/1954 Kobler .
2,709,318 5/1955 Benjamin .
2,800,743 7/1957 Meehan et al. .
2,854,786 10/1958 Sabo .
2,880,435 4/1959 Deutsch et al. ..... 403/349 X
2,895,753 7/1959 Fentiman .
2,902,821 9/1959 Kelly .
2,976,968 3/1961 Fentiman .
3,032,605 5/1962 Gerlach et al. .
3,275,351 9/1966 Fentiman .
3,286,391 11/1966 Mengeringhausen .
3,397,420 8/1968 Schneider ..... 403/229 X
3,458,949 8/1969 Young .
3,467,329 9/1969 Gitner .
3,564,758 2/1971 Willis .
3,587,658 6/1971 Gitner .
3,605,323 9/1971 Fischer .
3,626,632 12/1971 Bullock .
3,648,404 3/1972 Ogsbury et al. .
3,670,773 6/1972 Guerster .
3,680,802 8/1972 Guerster .
3,822,874 7/1974 Snyder et al. .
3,860,041 1/1975 Leiter .
3,863,405 2/1975 Leiter .
3,864,049 2/1975 Ono ..... 52/655.2
3,870,263 3/1975 Hardiman et al. .
3,882,650 5/1975 Gugliotta ..... 52/655.2
3,891,335 6/1975 Feil .
3,918,196 11/1975 Schleich .
4,020,566 5/1977 Dreiding ..... 446/126
4,078,328 3/1978 Rayment .
4,193,639 3/1980 Pauly et al. .
4,246,718 1/1981 Chatani .
4,302,900 12/1981 Rayner .
4,747,634 5/1988 Hoke .
4,758,196 7/1988 Wang .
4,850,599 6/1989 Ming .
4,958,474 9/1990 Adams ..... 52/646
4,963,115 10/1990 Davin et al. .
4,988,322 1/1991 Knudsen .
5,061,219 10/1991 Glickman .
5,063,969 11/1991 Snyder .
5,137,486 8/1992 Glickman .
5,222,738 6/1993 Muller .

FOREIGN PATENT DOCUMENTS 1339636 9/1963 France .

*Primary Examiner*—Randolph A. Reese
*Assistant Examiner*—Anthony Knight
*Attorney, Agent, or Firm*—Burns, Doane, Swecker & Mathis

[57] ABSTRACT

A flexible tie strut for supporting both compressive and tensile forces, the flexible tie strut including a tension member and a coaxially mounted compression member, the compression member and the tensile member being interconnected at their respective ends. A coupler for interconnecting struts, and a system of couplers and struts are also disclosed.

17 Claims, 4 Drawing Sheets

FLEXIBLE TIE STRUT

BACKGROUND OF THE INVENTION

FIELD OF THE INVENTION

The present invention is directed to a construction system, especially useful as a construction toy, display stand, instructional engineering aid and more particularly to a novel and improved type of flexible tie strut. The present invention also relates to couplers for connecting structural members and collapsible, self-erecting construction structures.

PRIOR ART

The range of construction toys available today for children older than six years is small and generally unappealing. There are two major problems associated with this section of the toy market. First, the short attention span of many of today's television-oriented children requires a toy to provide immediate gratification—the "push-together" ease of the Lego TM is now a minimum standard. Second, there is considerable buyer resistance to construction toys which manifestly do not contain sufficient components to build the impressive models so often seen in shop-window displays and advertising literature.

The primary types of structural members are beams, ties and struts. Beams are those members that are subjected to bending or flexure. Ties are members that are subjected to axial tension only. Struts are members that are subjected to axial compression only.

A variety of construction toys having combinations of connectors and structural elements acting primarily as struts which can be combined to form various structures is generally known. The structural elements of the known construction toys generally do not accommodate tensile loads or allow recoverable bending along their longitudinal axis. Such known elements seriously limit the size and strength of structures that can be assembled from them.

If a large structure is fabricated from existing combinations of connectors and structural elements, such structure can easily be damaged from the application of small loads. The reason for this is because the application of a relatively small load can cause significant bending stress on the struts, thus damaging them. The present invention is designed to support only compressive and tensile loads and cannot develop or support any significant bending loads. This feature of not being capable of supporting bending loads not only prevents damage in the event of overload of the structure, but also permits the structure to be collapsed and stored for later self-erection.

U.S. Pat. Nos. 5,137,486 to Glickman and 2,709,318 to Benjamin are typical of construction toys having hub-like connectors and strut-like structural elements adapted to be removably engaged, e.g., force fit, with the connectors to form composite structures. In general, none of these prior art devices provides positive coupling of strut-like members to withstand tensile loading, and none provides strut-like members with strength in tension and compression. In addition, none of the strut-like members in the prior art allows controlled flexure for purposes of assembly or the creation of self-erecting structures.

In U.S. Pat. No. 2,976,968 to Fentiman, an attempt is made at producing a construction system which is able to load the strut members in tension and compression, but this design is susceptible to damage due to the rigid nature of both the struts and the coupler.

In U.S. Pat. No. 4,302,900 to Rayner and also U.S. Pat. No. 3,286,391 to Mengeringhausen, a flexible connection means is disclosed. This connection means is able to accommodate a certain amount of abuse, but because the struts in both of the aforementioned patents are rigid, they are easily damaged if subjected to bending loads as might occur if they were to be stepped on. The present invention cannot be damaged in this way since it cannot support bending loads, and thus cannot be damaged by them.

Because of the way in which children use any construction toy, the following criteria were considered in the design of the subject invention:

- Maximum versatility of each part (as discussed above) to provide the largest possible variety of structures is desirable
- No tools are required
- Rapid assembly and disassembly are desirable
- Engineering principles are illustrated as graphically in this invention as bricklaying systems can be illustrated with block systems
- Random or violent disassembly must not damage the parts
- Tenacity of connections must not be dependent on close tolerance interference fits which may be affected by wear
- Parts must be large enough to not be easily lost
- Sharp edges and corners must be eliminated to prevent soreness to fingertips after an extended period of use In view of the limitations of prior art devices and, in general, the many primary types of structural elements required to build structures, it would be highly desirable to have one building element that would be selectively flexible (even recoverable) and have strength in tension and compression. It would also be desirable to have a unique coupler for positively locking with such a novel building element.

SUMMARY OF THE INVENTION

The purpose of the subject invention is to provide a construction system having elements which are flexible and recoverable along their longitudinal axis and which support tensile and compressive loads. To accomplish this purpose there is provided a construction system having a unique building element which is a flexible tie strut (hereinafter also referred to as "FTS") comprising a tension member and a co-axial compression member, the members being connected to each other at their respective ends. The tension member is preferably a flexible cable-like member which provides resistance to tensile forces that may be applied along the longitudinal axis of the FTS. The compression member is a one-piece or multiple-piece elongated member which is flexible about its longitudinal axis and which is substantially incompressible along its longitudinal axis when subjected to axial compression. The compression member is preferably a helical spring, the coils of which allow flexing of the spring but which contact each other and become incompressible when the spring is fully loaded. The novel combination of the tension member and compression member being connected to each other at their respective ends allows the FTS to bend along its length, to return to a straightened shape upon release of bending forces and to withstand tension and compression. In addition, the FTS may be designed to buckle at a predetermined compressive load by either varying the diameter or length of the compressive member or the initial preload on the tension member.

In one aspect of the invention there is provided a flexible tie strut for supporting both compressive and tensile forces comprising: a tension member being generally elongated, flexible along the length thereof and having first and second ends, said tension member providing resistance to tensile forces that may be applied to said first and second ends; and a compression member being generally elongated, flexible along the length thereof and having first and second ends, said compression member providing resistance to compressive forces that may be applied to said first and second ends, said first end of said tension member being operatively connected to said first end of said compression member, and said second end of said tension member being operatively connected to said second end of said compression member.

In another aspect of the invention there is provided a coupler for connecting struts comprising: a member having at least one opening for receiving struts to be connected therein; a retaining means connected to said member and positioned within said opening for locking engagement with struts to be connected; and loading means positioned within said opening to contact struts to be connected to apply force to struts to be connected to maintain such struts in contact with said retaining means.

In yet another aspect of the invention there is provided a self-erecting system comprising: a flexible tie strut for supporting both compressive and tensile forces having a tension member being generally elongated, flexible along the length thereof and having first and second ends, said tension member providing resistance to tensile forces that may be applied to said first and second ends and a compression member being generally elongated, flexible along the length thereof and having first and second ends, said compression member providing resistance to compressive forces that may be applied to said first and second ends, said first end of said tension member being operatively connected to said first end of said compression member and said second end of said tension member being operatively connected to said second end of said compression member; and a coupler for connecting flexible tie struts, the coupler member having at least one opening for receiving flexible tie struts to be connected therein, a retaining means connected to said member and positioned within said opening for locking engagement with flexible tie struts to be connected and loading means positioned within said opening to contact flexible tie struts to be connected to apply force to struts to be connected to maintain such flexible tie struts in contact with said retaining means.

DESCRIPTION OF THE DRAWING

In FIG. 3B, the compression member is a plurality of flat discs. In FIG. 3C, the compression member is a plurality of fitted (shown curved) discs.

FIG. 5B is a partial cross-sectional view identical to FIG. 5A illustrating retaining and loading means within an opening in the coupler.

DESCRIPTION OF THE PREFERRED EMBODIMENTS

Figure 1A:
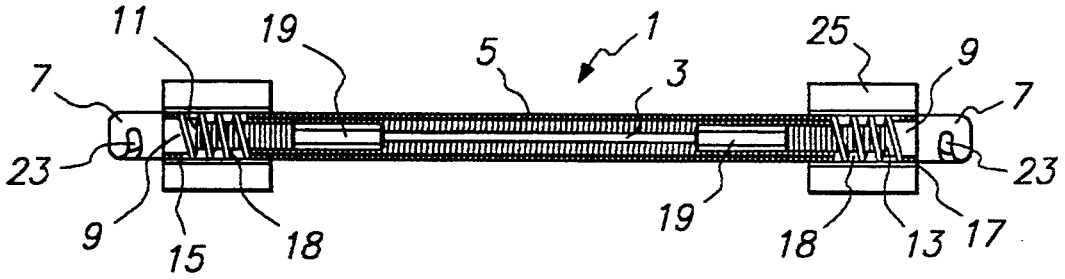
FIGS. 1A and 1B are partial cross-sectional plan views of a FTS with a pair of connector means at each end thereof. Flexure of the FTS is shown in FIG. 1B.
Figure 1B:
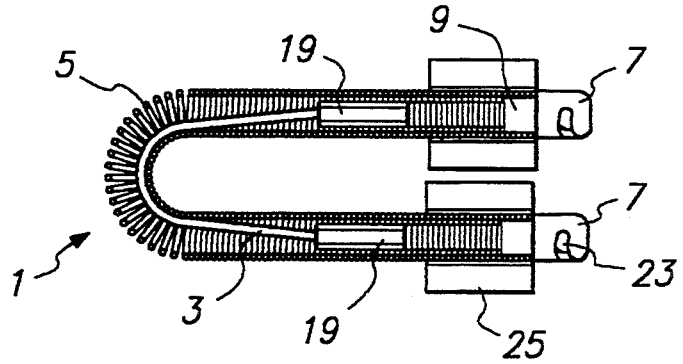

With continued reference to the drawing, FIGS. 1A and 1B illustrate the composite struts in accordance with the invention. Each assembly includes the FTS shown generally at I comprising tension member 3 and compression member 5. Tension member 3 and compression member 5 are operatively connected to each other at their respective ends by end pieces 9. Each assembly also includes a pair of connector means 7 connected to the FTS 1 to lock the FTS to objects to be connected. FIG. 1B illustrates the flexibility of the FTS.

Tension member 3 has a first end 11 and second end 13. Compression member 5 has a first end 15 and a second end 17. The first end 11 of the tension member is operatively interconnected to the first end 15 of the compression member 5, and the second end 13 of the tension member 3 is operatively interconnected with the second end 17 of the compression member 5. The cross-sectioned portions of FIGS. 1A and 1B illustrate operative interconnection of ends 11 and 13 of tension member 3 and ends 15 and 17 of compression member 5 by compliant sections 18 of compression member 5. One or both compliant (compressible) sections 18 of compression member 5 may be used to allow a greater range of flexibility of compression member 5. In FIG 1B, the allowable compressibility of compliant section 18 has been utilized by the flexure of the FTS 1.

Figure 2A:
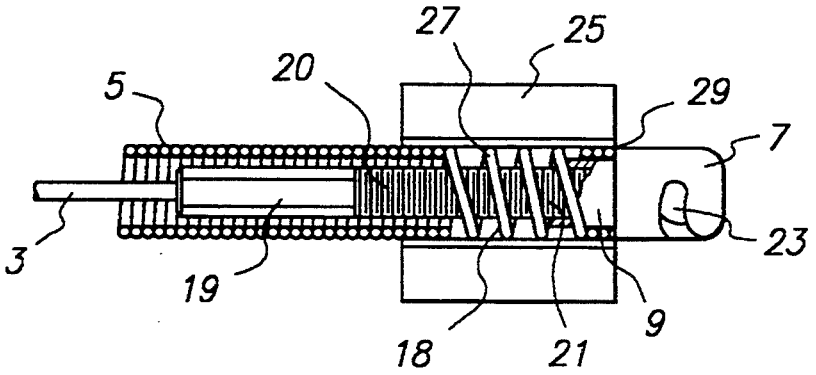
FIG. 2A is an enlarged cross-sectional view of one end of the FTS shown in FIG. 1A.

As can be seen more clearly in FIG. 2A, tension member 3 is shown to be a cable-like member, the ends of the cable-like member being crimped or similarly connected inside partially threaded stud 19. The threaded portion 20 of the stud 19 engages a complementary internal threaded portion 21 of end piece 9. As shown in FIGS. 1–4, connector means 7 can be integral or a part of end pieces 9. Connector means 7 further includes end portion 23 for locking an assembled FTS 1 to objects to be connected, as will be discussed later in greater detail. Connector means 7 also includes an integral knob portion 25 which allows manipulation and especially rotation of end portion 23 for purposes of coupling and locking assembled strut 1 to an object to be connected. It is understood that the ends of the tension member 3 and the compression member 5 may be operatively interconnected to support tensile and compression loads by means known to one skilled in the art which are considered part of this invention. Likewise, the connector means 7, the end piece 9 and threaded stud 19 may be an integral injection moldable part of metal or polymeric material. Specifically, the connector means may be injection molded onto the first and second ends of the tension means.

Figure 2B:
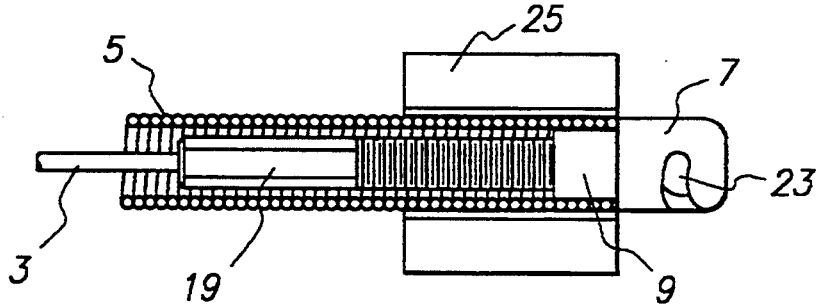
FIG. 2B is an enlarged cross-sectional view as in FIG. 2A of the end of the FTS as shown in FIG. 1B.

Flexibility of FTS 1 depends upon either the compressibility of compression member 5 or the elasticity of tension member 3. Compression member 5 is shown to be a helical spring-like member having coils which when fully compressed, i.e., when contacting each other, become the equivalent of a tube. The cross-section of such coils may be round, square, rectangular, etc. and may be segmented to vary along the axial length of the spring. If tension member 3 compresses all of the coils of compression member 5 into contact with each other, as seen in FIG. 2B, then FTS 1 will become inflexible and resistant to both tensile and compressive forces when used as a structural member. Various mechanisms to selectively apply tension to tension member 3 with respect to compressive member 5 are within the scope of the invention. FIGS. 1A–B, 2A–B, 3A and 4 illustrate alternative embodiments to adjust or control the interaction between tension member 3 and compression member 5.

Figure 3A:
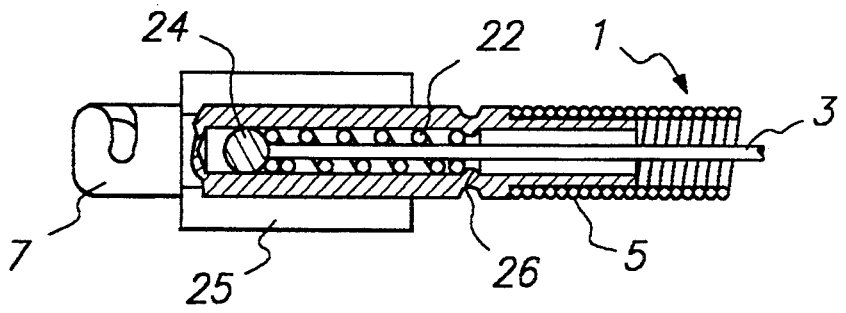
FIG. 3A is an enlarged view of an end portion of another embodiment of a FTS having alternate adjustable tension means.
Figure 3B:
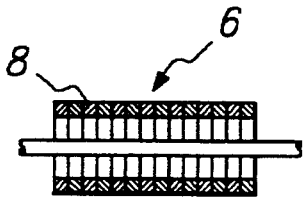
FIGS. 3B and 3C are enlarged views of a section of the FTS with alternate embodiments of compression members.
Figure 3C:
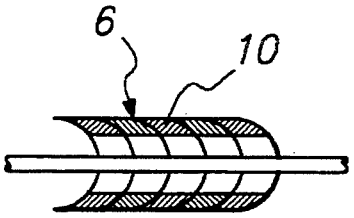

As seen in FIGS. 3B and 3C, compression member 5 may further comprise a plurality of incompressible members, shown generally at 6, such as beads or plates which when aligned or stacked on top of one another provide an incompressible column. The incompressible members 6 may be planar 8 or fitted 10, as shown in FIGS. 3B and 3C. Such members need only be strong in compression; thus they may be solid or composite, e.g., plates constructed of honeycomb sections.

In general, compression member 5 may be fabricated from a variety of suitable materials such as metals or polymers or combinations of materials which will provide the compressive resistance required of the invention. It is also within the scope of the invention to fabricate the compression member 5 either structurally and/or with a choice of materials to vary the compressibility of compression member 5, e.g., combinations of compressible, variably compressible and/or incompressible members.

FIGS. 2A–B and 3A disclose mechanical means to control the compressibility of compression member 5. It is within the scope of the invention to fabricate compression member 5 of a material or materials which change in strength or dimension as desired. An example of such a material would be a recoverable shape memory alloy, e.g., a nickel titanium shape memory alloy or heat-recoverable polymeric materials or the like.

The strength of a structure constructed from the FTS ideally is limited by the compressive load imposed upon an individual FTS. As the load on a structure is increased, the structure will remain stable until the critical buckling load of an individual FTS is reached. When this occurs the structure will partially or fully collapse. The generic Euler equation governs this buckling behavior. As known to one skilled in the art, buckling load, $F_{cr}$ $$F_{cr} = K\left[\pi^2 \frac{EI}{L^2}\right]$$

where L is the strut length (in); I is the section modulus ($in^4$); E is elastic modulus (psi); and K is a constant. For purposes of the subject invention, K equals 1. Since the strut of the subject invention is a composite structure E must be measured experimentally.

As noted earlier with respect to the subject invention, by increasing the diameter of the struts as their length increases it is possible to provide a uniform buckling factor throughout the structure. As can be appreciated the FTS will not be damaged due to buckling because it cannot develop bending stresses because of its construction. Removal of the load will allow the FTS to return to its straightened shape. Likewise, a structure made of a plurality of FTS will self-erect when unloaded after collapse. This inherent characteristic of a structure constructed of FTS elements allows it to not only resist damage, but also allows it to be collapsed and stored for later self-erection.

Tension member 3 is preferably a cable which is flexible in bending along the length thereof but generally fixed in length to support tensile loads. Tension member 3 may be a monofilament of polymeric or metallic materials or a multiple-strand cable of one or more materials as desired. It is also within the scope of the invention to have tension member 3 made of materials which also change in strength and/or dimension as desired, for example, heat-recoverable shape memory alloys or heat-recoverable polymers. It is further within the scope of the invention to make the tension member 3 from materials that exhibit a high degree of flexibility such as shape memory alloys of nickel titanium and other materials which exhibit pseudo elasticity or superelasticity. Shape memory alloys and polymers are well known to one skilled in the art, and the selection of appropriate materials for desired loading and/or motion is considered to be within the scope of this invention. Since the flexibility of the FTS 1, as seen in FIGS. 1A–B, is dependent upon the degree of preloaded compression of the compression member 5 determined by the tension in tension member 3, it is within the scope of the invention to vary the materials and/or mechanical interconnection of these members to control the flexibility of the FTS 1.

FIG. 3A illustrates the end portion of an alternate embodiment of FTS 1 having tension member 3 and compression member 5. In this embodiment, a spring 22 is interposed between tension member 3 and compression member 5. Specifically, at one end, spring 22 contacts stop 24 on tension member 3, and at the other end, spring 22 contacts crimp stop 26 which is in turn connected to compression means 5. Stop 24 is free to move and compress spring 22 upon flexure of FTS 1.

It should be understood that the flexibility characteristics of FTS 1 including its having coaxially mounted compression and tension members are different and superior to the flexibility characteristics of say, for example, a tightly coiled elongated coil spring alone. A coil spring alone does not have sufficient stiffness to even support itself when held horizontally at one end. In contrast, the FTS will remain rigid and straight when supported at one end—even in long lengths. It is understood that it is well within the scope of the invention to reverse or eliminate the coaxial relationship of the tension and compression members 3 and 5, respectively, by mechanical expedients well known to one skilled in the art. Specifically, the combination of the tension and compression members 3 and 5, respectively, provides an overall structure when the compression member 5 is a helical spring or like functioning member, as described earlier, having some degree of compressibility that will snap back into column as compared to a spring member alone. This feature allows the unique strut of the invention to be used advantageously for self-erecting structures, as will be discussed later in greater detail.

Connector means 7 is shown to be a well-known quarter turn fastener. One such fastener is known as a DZUS Standard Line fastener available from DZUS Fastener Co., Inc., West Islip, N.Y. It can be appreciated that both tension member 3 and compression member 5 inherently allow rotation of their respective first and second ends with respect to each other. Relative rotation occurs when first connecting one end of FTS 1 and then subsequently connecting the other end. It is understood that other types of connecting means such as a pin and clevis, a threaded stud and nut, etc. are within the scope of the invention. Likewise, connector means 7 may comprise the male or the female portions of any connector known to one skilled in the art that will support both tensile and compressive loads.

FIG. 2A shows an enlarged view of a portion of FTS 1. As seen in FIG. 2A, compression member 5, which is shown to be a helical spring, a section 18 wherein the coils of the spring are spaced from each other to provide a specific amount of compression to compressive member 5. The coils of expanded portion 18 abut against portion 29 of end means 9 which is operatively connected by a stud 19 to tension member 3. It can be appreciated that the spacing and/or strength of the coils of the spring 27 will control the snap action of FTS 1.

Figure 4:
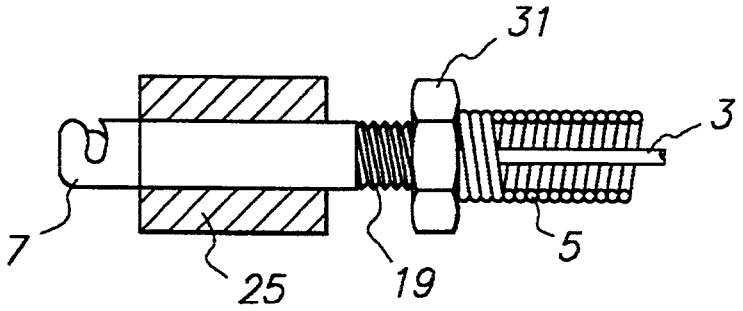
FIG. 4 is an enlarged view similar to FIG. 3A of another alternate embodiment having a jam nut to control compressibility and flex of the FTS.

FIG. 4 illustrates an alternate embodiment similar to FIGS. 2A–B wherein the compression of compression member 5 by tension member 3 may be controlled and/or eliminated. In FIG. 4, the outside of stud 19 is threaded, and compression nut 3 1 is provided to selectively compress the coils of compression member 5 to reduce and/or eliminate any spacing between the coils of compressive member 5. With the embodiment illustrated in FIG. 4, the rigidity of an assembled structure of FTS 1 can be increased subsequent to assembly by tightening compression nut 31 associated with each FTS. It is understood that other mechanical means besides threaded stud 19 and compression nut 31 are within the scope of the invention, such as a sliding sleeve, a spacer sleeve and other mechanical mechanisms that will compress the coils of compression member 5 and are well known to a person having ordinary skill in the art.

FIGS. 3B and 3C illustrate a compression member 5 fabricated from a plurality of incompressible members 6, as discussed earlier. The members may be planar and/or fitted to each other, as seen in FIG. 3B.

Figure 5A:
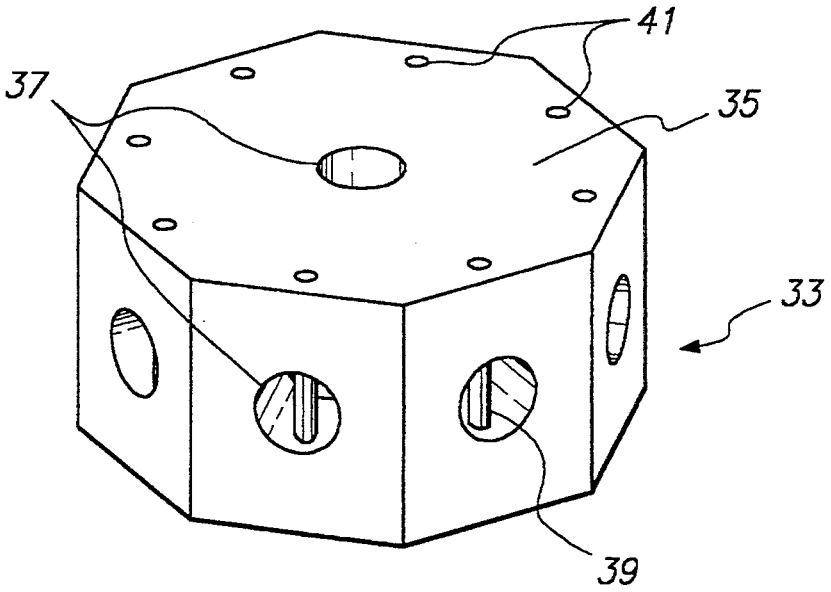
FIGS. 5A and 5B are perspective views of an assembled coupler in accordance with the invention.
Figure 5B:
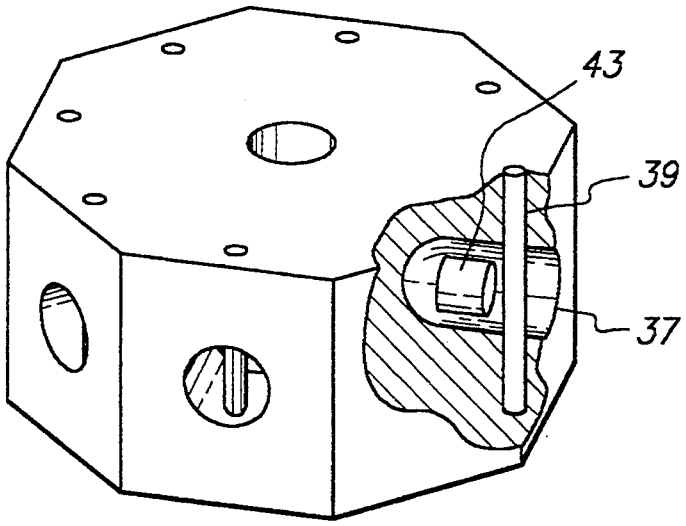

FIGS. 5A and 5B show a coupler, shown generally at 33, for connecting and interconnecting FTS 1 or the like. Coupler 33 includes member 35 having at least one opening 37 therein for receiving FTS 1 to be connected thereto. A retaining means 39, which is shown to be a plurality of pins, extends transversely through opening 37. The pin of the retaining means 39 is supported in member 35 at each end thereof in apertures 41. It can be seen with reference to FIGS. 1, 2A–B and 3A that insertion of connector means 7 into opening 37 will engage connector means 7 with retaining means 39 and that rotation of connector means 7 will lock connector means 7 to the pin of retaining means 39. Deeper within the opening 37, a loading means 43 is provided to contact the end of the connector means inserted in the opening 37 and to lock the connector means 7 into contact with retaining means 39.

It can be appreciated that the coupler 33 can have a plurality of openings 37 to accommodate the connection of struts in all three dimensions. It can be appreciated that the top surface 45 of the member 35 can be contoured and provided with further openings (not shown) to accommodate struts at angles to surface 45 other than perpendicular.

Figure 6:
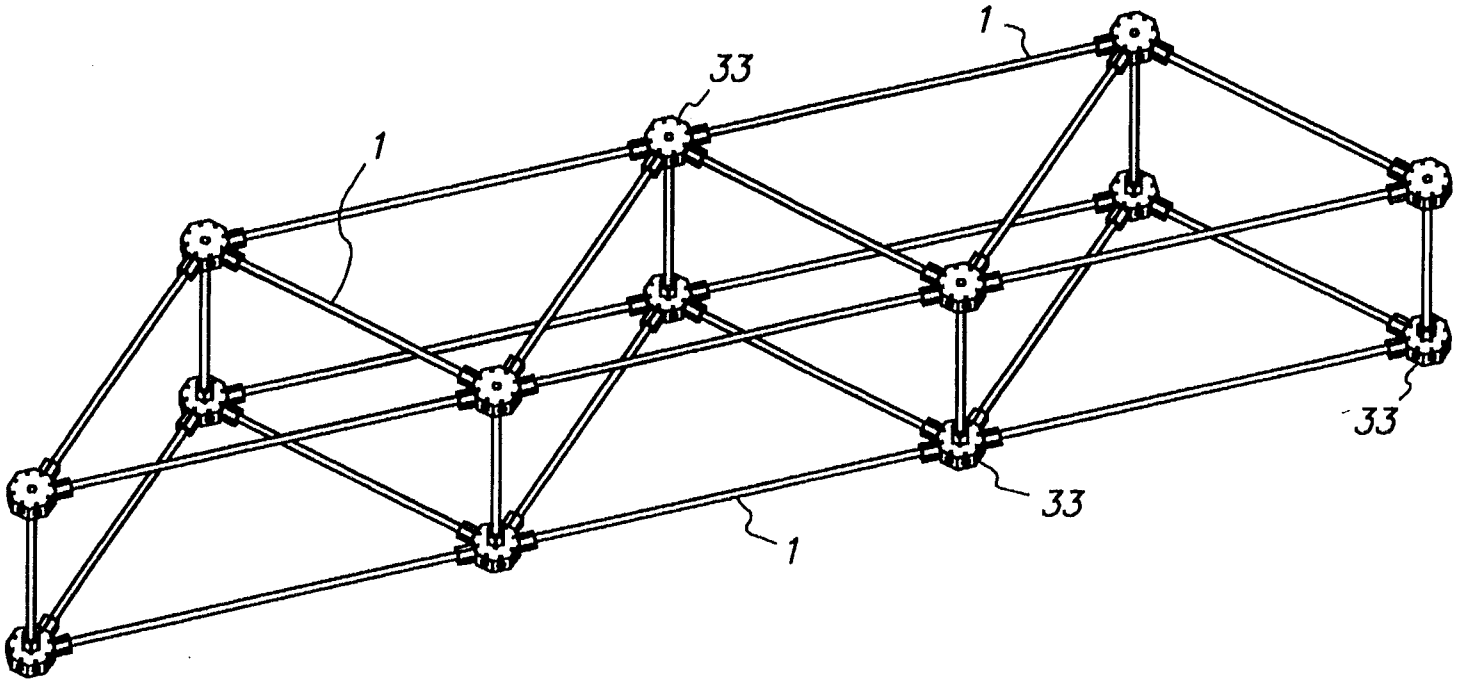
FIG. 6 is a perspective view of a self-erecting structure of FTS and couplers in accordance with the invention.

FIG. 6 illustrates a structure fabricated from a plurality of flexible tie struts 1 and couplers 33. It can be appreciated that each FTS 1, even after assembly, can be flexed, as shown in FIG. 1, and the entire assembly compressed.

Modifications and variations of the present invention will be apparent to those having ordinary skill in the art having read the above teachings, and the present invention is thus limited only by the spirit and scope of the following claims.

What is claimed is:

1. A flexible tie strut for supporting both compressive and tensile forces comprising:

a tension member being generally elongated, flexible along the length thereof and having first and second ends, said tension member providing resistance to tensile forces that may be applied to said first and second ends; and a compression member being generally elongated, flexible along the length thereof and having first and second ends, said compression member having a substantial portion thereof which is incompressible, said compression member providing resistance to compressive forces that may be applied to said first and second ends, said first end of said tension member being operatively connected to said first end of said compression member and said second end of said tension member being operatively connected to said second end of said compression member, said ends rotatable with respect to each other to avoid the accumulation of torsional stress to the tension and compression members, said flexible tie strut capable of supporting loads at both ends at the same time, at least one of said members having some compliance to allow flexibility of the tie strut.

2. A flexible tie strut as in claim 1 wherein said compression member is a helical spring.

3. A flexible tie strut as in claim 2 wherein said helical spring has coils and said coils are generally in contact with each other and wherein a portion of said helical spring has coils which are spaced from each other.

4. A flexible tie strut as in claim 2 wherein at least a portion of said helical spring is fabricated from a heat-recoverable material to alter the compressibility of said compression member.

5. A flexible tie strut as in claim 1 wherein said compression member comprises a plurality of generally incompressible elements in axial alignment with said tension member.

6. A flexible tie strut as in claim 1 wherein said tension member is a cable.

7. A flexible tie strut as in claim 1 wherein said compression member is mounted concentrically about said tension member.

8. A flexible tie strut as in claim 1 further including adjusting means operatively connecting one end of said tension member and one end of said compression member, said adjusting means varying the compression of said compression member to affect the flexibility of said strut.

9. A flexible tie strut as in claim 1 wherein at least a portion of said tension member is made of a heat-recoverable material to vary the compression of said compression member.

10. A flexible tie strut as in claim 1 wherein said tension member further includes a biasing means at one end thereof to vary the compression on said compression member.

11. A flexible tie strut as in claim 1 further including a first connector means attached to the first ends of said tension member and said compression member and a second connector means attached to said second ends of said tension member and compression member to connect said flexible tie strut to objects to be connected.

12. A flexible tie strut as in claim 11 wherein said tension member and said compression member have a common longitudinal axis and said first and second connector means are rotatable with respect to each other about said longitudinal axis.

13. A flexible tie strut as in claim 11 wherein said first and second connector means are male-type connectors.

14. A flexible tie strut as in claim 13 wherein said connector means are quarter turn type connectors.

15. A flexible tie strut as in claim 11 wherein said connection means is injection molded onto the first and second ends of the tension member.

16. A flexible tie strut as in claim 1 wherein at least a portion of said tension member is fabricated from a shape memory alloy.

17. A construction system comprising:

a flexible tie strut for supporting both compressive and tensile forces having a tension member being generally elongated, flexible along the length thereof and having first and second ends, said tension member providing resistance to tensile forces that may be applied to said first and second ends and a compression member being generally elongated, flexible along the length thereof and having first and second ends, said compression member having a substantial portion thereof which is incompressible, said compression member providing resistance to compressive forces that may be applied to said first and second ends, said first end of said tension member being operatively connected to said first end of said compression member and said second end of said tension member being operatively connected to said second end of said compression member, said ends rotatable with respect to each other to avoid the accumulation of torsional stress to the tension and compression members, said flexible tie strut capable of supporting loads at both ends at the same time, at least one of said members having some compliance to allow flexibility of the tie strut; and a coupler for connecting struts, the coupler having a member having at least one opening for receiving a strut to be connected therein and a retaining means connected to said member and positioned within said opening for locking engagement with a strut to be connected.

* * * * *